US007772170B2

(12) United States Patent
Hiza et al.

(10) Patent No.: US 7,772,170 B2
(45) Date of Patent: Aug. 10, 2010

(54) LUBRICATING GREASES CONTAINING ANTIMONY DITHIOCARBAMATES

(75) Inventors: Ronald J. Hiza, Monroe, CT (US); Gaston A. Aguilar, Milford, CT (US); Steven G. Donnelly, Bethel, CT (US); Francis S. Cheng, West Hartford, CT (US); Ronald J. Tepper, Fairfield, CT (US)

(73) Assignee: R.T. Vanderbilt Company, Inc., Norwalk, CT (US)

( * ) Notice: Subject to any disclaimer, the term of this patent is extended or adjusted under 35 U.S.C. 154(b) by 1190 days.

(21) Appl. No.: 11/351,414

(22) Filed: Feb. 10, 2006

(65) Prior Publication Data

US 2006/0183648 A1 Aug. 17, 2006

Related U.S. Application Data

(60) Provisional application No. 60/652,155, filed on Feb. 11, 2005.

(51) Int. Cl.
*C10M 135/18* (2006.01)

(52) U.S. Cl. ..... 508/363; 508/364; 508/443; 508/444; 508/501; 508/503

(58) Field of Classification Search ..... 508/362, 508/363, 364, 365, 443, 444, 547
See application file for complete search history.

(56) References Cited

U.S. PATENT DOCUMENTS

| | | | | | |
|---|---|---|---|---|---|
| 2,492,314 | A | * | 12/1949 | Olin et al. | 556/38 |
| 3,139,045 | A | | 6/1964 | Rojakovick | |
| 3,139,405 | A | | 6/1964 | Farmer | |
| 3,230,168 | A | * | 1/1966 | Low | 508/443 |
| 3,354,085 | A | * | 11/1967 | Hotten | 508/443 |
| 4,479,883 | A | | 10/1984 | Shaub | |
| 5,246,604 | A | | 9/1993 | Vartanian | 252/25 |
| 5,246,605 | A | * | 9/1993 | Vartanian | 508/159 |
| 5,693,598 | A | | 12/1997 | Abraham | |
| 6,020,290 | A | | 2/2000 | Takata | |
| 6,110,877 | A | * | 8/2000 | Roberts | 508/363 |
| 6,352,961 | B1 | | 3/2002 | Iso | |
| 6,403,538 | B1 | | 6/2002 | Ozaki | |
| 6,432,888 | B1 | | 8/2002 | Komiya | |
| 2004/0224860 | A1 | * | 11/2004 | Baba et al. | 508/545 |

OTHER PUBLICATIONS

R.T. Vanderbilt Company, Inc. Industrial Minerals and Chemicals, Vanlube 73 Specification, Jul. 10, 2001, 30 Winfield Street PO Box 5150 Norwalk, Connecticut 06856-5150, (203)853-1400, p. 1.*

R.T. Vanderbilt Company, Inc. Industrial Mineral and Chemicals, Vanlube AZ Specification, Jul. 26, 2001, 30 Winfield Street PO Box 5150 Norwalk, Connecticut 06856-5150, (203)853-1400, p. 1.*

* cited by examiner

*Primary Examiner*—Ellen M McAvoy
*Assistant Examiner*—Vishal Vasisth
(74) *Attorney, Agent, or Firm*—Norris, McLaughlin & Marcus

(57) ABSTRACT

Antimony dithiocarbamate is known to provide extreme pressure (EP) protection in lubricating compositions, such as grease. However, there is a desire to reduce the amount of antimony used in such compositions, while still maintaining acceptable EP performance. It has now been found by using small amounts of either ammonium dithiocarbamate or zinc dithiocarbamate in combination with the antimony dithiocarbamate (SbDTC), a lower amount of SbDTC can be used in the lubricating composition while still maintaining excellent or exceptional EP protection. To counteract the corrosive effects of the SbDTC and ammonium dithiocarbamate composition, it has been found that compounds containing a carboxylic acid group are effective in avoiding copper corrosion.

6 Claims, No Drawings

LUBRICATING GREASES CONTAINING ANTIMONY DITHIOCARBAMATES

This application is a Continuation of Ser. No. 60/652,155, filed Feb. 11, 2005.

BACKGROUND OF THE INVENTION

1. Field of the Invention

The invention relates to compositions comprising antimony dithiocarbamates in combination with ammonium or zinc dithiocarbamates, as additives for lubricating grease in order to provide extreme pressure (EP) protection while reducing the amount of antimony. The addition of a compound containing at least one carboxylic acid functional group can act to avoid or reduce the copper corrosion effect resulting from the use of antimony, and antimony in combination with ammonium dithiocarbamate.

2. Description of the Prior Art

Antimony dithiocarbamates are well known in the art for their usefulness as extreme pressure (EP) agents, and are exceptionally useful as EP additives in lubricating greases. Representative patents disclosing the use of antimony dithiocarbamates are U.S. Pat. Nos. 3,139,405 and 5,246,604, which are incorporated herein by reference. However, environmental and health issues are restricting antimony levels in lubricants and greases.

Accordingly, there is a need for compositions which boost EP performance of antimony dithiocarbamates in soap-based greases, allowing for a reduction in the effective amount of antimony needed to maintain desired performance.

Specifically, the EP performance is improved by preparing antimony dithiocarbamate compositions containing ammonium dithiocarbamate and/or zinc dithiocarbamate. Antimony dithiocarbamates and antimony dithiocarbamate compositions described above can be corrosive to nonferrous metals such as copper when used in soap-based greases. The present invention teaches that compounds containing carboxylic acid functional groups are effective copper corrosion inhibitors for these grease compositions.

SUMMARY OF THE INVENTION

Antimony dithiocarbamate is known to provide extreme pressure (EP) protection in lubricating compositions, such as grease. However, there is a desire to reduce the amount of antimony used in such compositions, while still maintaining acceptable EP performance. It has now been found by using small amounts of either ammonium dithiocarbamate (AmDTC) or zinc dithiocarbamate (ZnDTC) in combination with the antimony dithiocarbamate (SbDTC), a lower amount of SbDTC can be used in the lubricating composition. To counteract the corrosive effects of the SbDTC and ammonium dithiocarbamate composition, it has been found that compounds containing a carboxylic acid group are effective in avoiding copper corrosion. Thus, the invention relates to additive compositions containing combinations of antimony dithiocarbamate and ammonium dithiocarbamate, optionally with a compound having a carboxylic-acid containing group; additive compositions containing combinations for antimony dithiocarbamate and zinc dithiocarbamate; lubricating compositions, preferably greases, containing up to 10% by mass of such additive compositions; and a method for boosting EP performance of antimony dithiocarbamates comprising incorporating the additive compositions in a lubricating composition.

DETAILED DESCRIPTION OF THE INVENTION

Base grease compositions consist of a lubricating oil and a thickener system. Generally, the base oil and thickener system will comprise 65 to 95, and 3 to 10 mass percent of the final grease respectively. The base oils most commonly used are petroleum oils or synthetic base oils. The most common thickener systems known in the art are lithium soaps, and lithium-complex soaps, which are produced by the neutralization of fatty carboxylic acids or the saponification of fatty carboxylic acid esters with lithium hydroxide typically directly in the base fluids. Lithium-complex greases differ from simple lithium greases by incorporation of a complexing agent, which usually consists of di-carboxylic acids.

The antimony dithiocarbamates of the invention are represented by the general formula (1):

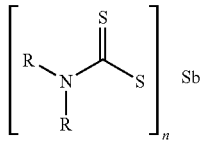

(1)

$n = 3$

Hydrocarbon groups represented by R include, but are not limited to alkyl groups, alkenyl groups, aryl groups, cycloalkyl groups, cycloalkenyl groups and mixtures thereof. Representative alkyl groups include methyl, ethyl, n-propyl, iso-propyl, n-butyl, iso-butyl, secondary butyl, n-pentyl, amyl, neopentyl, n-hexyl, n-heptyl, secondary heptyl, n-octyl, secondary octyl, 2-ethyl hexyl, n-nonyl, secondary nonyl, undecyl, secondary undecyl, dodecyl, secondary dodecyl, tridecyl, secondary tridecyl, tetradecyl, secondary tetradecyl, hexadecyl, secondary hexadecyl, stearyl, icosyl, docosyl, tetracosyl, 2-butyloctyl, 2-butyldecyl, 2-hexyloctyl, 2-hexydecyl, 2-octyldecyl, 2-hexydodecyl, 2-octyldodecyl, 2-decyltetradecyl, 2-dodecylhexadecyl, 2-hexyldecyloctyldecyl, 2-tetradecyloctyldecy, monomethyl branched-isostearyl, etc. Antimony dithiocarbamates of the invention are well known in the art and are available commercially. Preferred are the oil-soluble antimony dithiocarbamates having 1 to 50 carbon atoms and more preferably the oil-soluble antimony dialkyldithiocarbamates having 1 to 24, preferably 4 to 8, carbon atoms in the alkyl group.

The alkenyl groups include, but are not limited to vinyl, allyl, propenyl, isobutenyl, pentenyl, isopentenyl, hexenyl, heptenyl, octenyl, nonenyl, decenyl, undecenyl, dodecenyl, tetradecenyl, oleyl, etc.

As the aryl groups, there may be mentioned, for instance, phenyl, toluyl, xylyl, cumenyl, mesityl, benzyl, phenethyl, styryl, cinnamyl, benzahydryl, trityl, ethylphenyl, propylphenyl, butylphenyl, pentylphenyl, hexylphenyl, heptaphenyl, octylphenyl, nonylphenyl, decylphenyl, undecylphenyl, dodecylphenyl benzylphenyl, styrenated phenyl, p-cumylphenyl, α-naphthyl, β-naphthyl groups and the like.

The cycloalkyl groups and cycloalkenyl groups include, but are not limited to cyclopentyl, cyclohexyl, cycloheptyl, methylcyclopentyl, methylcyclohexyl, methylcycloheptyl, cyclopentenyl, cyclohexenyl, cycloheptenyl, methylcyclopentenyl, methylcyclohexenyl, methylcycloheptenyl groups and the like. Preferred compounds are oil-soluble having alkyl groups containing 1 to 24 carbons and more preferably 4 to 8 carbons. The most preferred is antimony diamyldithiocarbamate. Antimony diamyl dithiocarbamates generally comprise 0.5 to 3 and more preferably 1 to 2 mass percent of the final grease composition. Final grease compositions preferably contain 0.07 to 0.45 and most preferably 0.15 to 0.30 mass percent antimony.

In this invention, the load-carrying capability of greases containing antimony dithiocarbamate with respect to its EP performance is improved by the incorporation of antimony dithiocarbamate compositions containing ammonium dithiocarbamate and/or zinc dithiocarbamate. Ammonium and zinc dithiocarbamates are not EP additives by themselves, but the incorporation of these compounds significantly improves the load carrying ability of greases treated with antimony dithiocarbamates, while allowing for a reduced amount of required antimony.

One advantage of using ammonium and zinc dithiocarbamates is that their incorporation can be accomplished in situ in the antimony dithiocarbamate manufacturing process. As depicted in FIG. 1, ammonium dithiocarbamates are intermediate products in the preparation of antimony dithiocarbamates. Thus, the level of ammonium dithiocarbamate in a composition is controlled by the stoichiometry of the reaction. This invention teaches that EP performance is improved when antimony dithiocarbamates are produced using an excess of carbon disulfide ($CS_2$) and secondary amine ($R_2NH$) at 1:2 molar ratio. In effect, the ammonium dithiocarbamate increases the total dithiocarbamate (DTC) content of the additive composition. The molar ratio of total DTC to antimony (Sb) is increased over the 3:1 ratio of dithiocarbamate to Sb in pure antimony dithiocarbamate. For grease compositions containing antimony dithiocarbamate and ammonium dithiocarbamate, the preferred total DTC/Sb molar ratios are 3.06 to 3.50, and the most preferred ratio is 3.1:1. It is noteworthy that as ammonium dithiocarbamate does not itself provide EP protection, there is clearly a synergy between the AmDTC and SbDTC which allows for a small amount of AmDTC to boost the EP performance of SbDTC. Therefore, it appears that it is not a mere increase in the total DTC amount per se which provides the improved results, but a special relationship between the AmDTC and SbDTC in particular.

Reaction 1: Reaction mechanism for preparation of antimony dithiocarbamate using a balanced raw material feed.

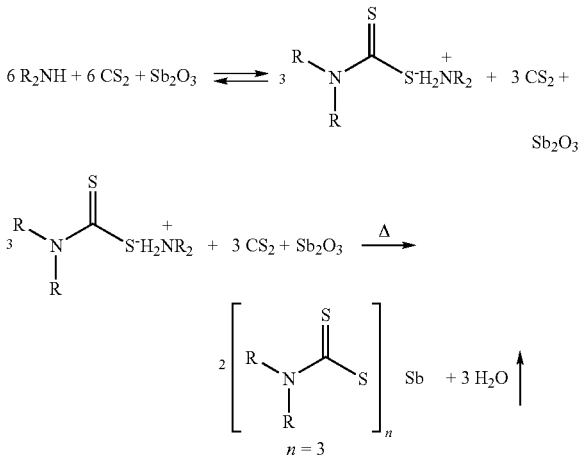

In the case of additive compositions containing zinc dithiocarbamates, the manufacturing procedure involves the additional zinc reagent along with the antimony reagent. As shown in FIG. 2, As with ammonium dithiocarbamate, the zinc dithiocarbamate alone is not an EP protection provider, but instead acts synergistically with SbDTC to enhance the effect of SbDTC. The addition of ZnDTC increases total DTC/Sb molar ratio over the 3:1 ratio of pure antimony dithiocarbamate. For grease compositions containing antimony dithiocarbamate and zinc dithiocarbamate, the preferred total DTC/Sb molar ratios are 3.1 to 6.2 and the most preferred ratios are 3.7 to 6.1:1. For both AmDTC and ZnDTC, the effect of boosting EP performance of SbDTC is achieved without having to increase the SbDTC content.

Reaction 2: Reaction scheme for dual synthesis of antimony and zinc dithiocarbamates.

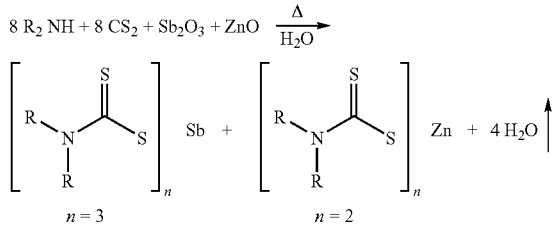

It is expected that a composition containing both zinc dithiocarbamate and ammonium dithiocarbamate together with antimony dithiocarbamate will also be effective according to the teaching of the invention. A composition in this regard can be obtained using antimony and zinc starting groups as set forth in Reaction 2, along with excess reactants as set out in Reaction 1.

The hydrocarbon groups for the ammonium dithiocarbamates and zinc dithiocarbamates as represented by R in FIG. 1 and FIG. 2 are the same as described for antimony dithiocarbamates. Preferred compounds are oil-soluble having alkyl groups containing 1 to 24 carbons and more preferably 4 to 8 carbons. Representative R groups include methyl, ethyl, n-propyl, iso-propyl, n-butyl, sec-butyl, n-pentyl, amyl, n-hexyl, n-heptyl, n-octyl, 3-ethyl hexyl, n-nonyl, undecyl, dodecyl, tridecyl, etc. Preferred are diamyl ammonium diamyldithiocarbamate, and zinc diamyldithiocarbamate.

The corrosive characteristics of the greases formulated with the aforementioned additive compositions are improved by the incorporation of compounds containing at least one carboxylic acid (—COOH) functional group. This includes but is not limited to fatty acids, and alkyl succinic acid half ester derivatives. Fatty acids contain from about 8 up to about 30, or from about 12 up to about 24 carbon atoms. Common saturated fatty acids are pentanoic or valeric, isopentanoic, hexanoic, heptanoic, octanoic, 2-ethylhexanoic, nonanoic or pelargonic, isononanoic, decanoic, hexadecanoic or palmitic, and octadecanoic or stearic acids. Unsaturated fatty acids are 9-octadecenoic acid or oleic, 9,12-octadecenoic or linoleic, and 9,12,15-octadecenoic or linolenic acids.

Alkyl succinic half ester acids are of formula (2):

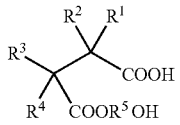

(2)

wherein $R_1$, $R_2$, $R_3$, and $R_4$ are hydrogen and/or alkyl groups, at least one of $R_1$, $R_2$, $R_3$, and $R_4$ is always an alkyl group, and $R_5$ is always an alkyl group. For $R_1$, $R_2$, $R_3$, and $R_4$, alkyl groups are polybutyl moiety, fatty acids, isoaliphatic acids (e.g., 8-methyloctadecanoic acid). For $R_5$, alkyl groups contain 2 to 6 carbons. Commercial examples of (2) are VANLUBE® RI-A lubricant additive (alkyl succinic acid half ester derivative) available from R. T. Vanderbilt Company, Inc., and LUBRIZOL® 859 additive.

Corrosion inhibitors will comprise 1 to 30 mass percent of the antimony dithiocarbamate compositions. In terms of final grease compositions, the corrosion inhibitor will generally comprise 0.01 to 1 mass percent.

Along with comparative examples, the following examples illustrate inventive methods to produce antimony dithiocarbamate compositions with improve EP performance and corrosion characteristics. Table 1 summarizes the chemical composition of these examples.

EXAMPLE 1 (COMPARATIVE)

Preparation of Mixed Antimony dialkyl dithiocarbamate (diamyl and di-2-ethylhexyl dithiocarbamate) using Balanced Stoichiometry (FC539-082) The product was prepared using reactant molar ratio of 6.00:6.00:1.) ($R_2NH:CS_2:Sb_2O_3$). Specifically, diamylamine (49.6 grams, 0.315 moles), di-2-ethylhexylamine (9.5 grams, 0.039 moles), and $Sb_2O_3$ (17.2 grams, 0.059 moles) and CS2 (27.0 grams, 0.355 moles) were reacted and diluted with 97 grams of diluent oil. The product was filtered to remove excess $Sb_2O_3$. The final product was yellow liquid containing 43 mass percent antimony diamyl dithiocarbamate, 7 mass percent di-2-ethylhexyl-dithiocarbamate and 50 mass percent diluent oil. The antimony content was 7.41 mass percent

EXAMPLE 2 (COMPARATIVE)

Preparation of Antimony diamyl dithiocarbamate using Excess $Sb_2O_3$ (RJT543-143) The product was prepared using reactant molar ratio of 5.86:6.49:1.00 ($R_2NH:CS_2:Sb_2O_3$). Specifically, diamyl amine (90.5 grams, 0.575 moles), and $Sb_2O_3$ (28.6 grams, 0.098 moles), and $CS_2$ (48.5 grams, 0.637 moles) were reacted and diluted with 160.6 grams of diluent oil. The product was filtered through filter aid earth to remove excess $Sb_2O_3$. The final product was a clear yellow liquid containing 50 mass percent of antimony diamyl dithiocarbamate, and 50 mass percent of diluent oil. The antimony content was 7.45 mass percent.

EXAMPLE 3 (COMPARATIVE)

Preparation of Antimony diamyl dithiocarbamate Using Balanced Stoichiometry (FC539-079) The product was prepared using reactant molar ratio of 6.00:6.00:1.00 ($R_2NH:CS_2:Sb_2O_3$). Specifically, diamyl amine (115.2 grams, 0.732 moles), and $Sb_2O_3$ (35.7 grams, 0.122 moles) and $CS_2$ (55.8 grams, 0.732 moles) were reacted and with diluted with 50 grams of diluent oil. The product was filtered to remove excess $Sb_2O_3$. The final product was yellow liquid containing 83 mass percent antimony diamyl dithiocarbamate, 17 mass percent diluent oil, and The antimony content was 11.92 mass percent.

EXAMPLE 4 (INVENTIVE)

Preparation of Antimony diamyl dithiocarbamate using Excess_amine and $CS_2$ (FC539-088) The product was prepared using reactant molar ratio of 6.45:6.23:1.00 ($R_2NH:CS_2:Sb_2O_3$). Specifically, diamyl amine (77.0 grams, 0.490 moles), and $Sb_2O_3$ (22.3 grams, 0.076 moles) and $CS_2$ (36.1 grams, 0.474 moles) reacted and with diluted with 118.7 grams of diluent oil. The product was filtered to remove traces of un-reacted $Sb_2O_3$. The final product was a bright and clear yellow liquid containing 50 mass percent antimony diamyl dithiocarbamate, 2.5 mass percent diamyl ammonium diamyl dithiocarbamate, and 47.5 mass percent diluent oil. The antimony content was 7.45 mass percent.

EXAMPLE 5 (INVENTIVE)

Preparation of Antimony diamyl dithiocarbamate Containing diamyl ammonium diamyl dithiocarbamate, and VANLUBE RI-A (FC539-089) The product was prepared using reactant molar ratio of 6.40:8.52:1.00 ($R_2NH:CS_2:Sb_2O_3$). Specifically, diamyl amine (55.4 grams, 0.352 moles), and $Sb_2O_3$ (16.0 grams, 0.055 moles) and $CS_2$ (35.8 grams, 0.469 moles) were reacted and diluted with 85.5 grams of diluent oil. The product was filtered to remove traces of un-reacted $Sb_2O_3$. To this product was added 77.1 grams of VANLUBE RI-A. The final product was a bright and clear yellow liquid containing 35 mass percent antimony diamyl dithiocarbamate, 1.7 mass percent diamyl ammonium diamyl dithiocarbamate, 30 mass percent VANLUBE RI-A, and 33.3 mass percent diluent oil. The antimony content was 5.2 mass percent.

EXAMPLE 6 (INVENTIVE)

Preparation of Antimony diamyl dithiocarbamate Containing diamyl ammonium diamyl dithiocarbamate, and VANLUBE RI-A Example 5 is Example 3 after the addition of 2.5 mass percent VANLUBE RI-A. The product is bright and clear yellow liquid containing 48.8 mass percent antimony diamyl dithiocarbamate and 2.4 mass percent diamyl ammonium diamyl dithiocarbamate, and 46.3 mass percent diluent oil. The antimony content was 7.26 mass percent.

EXAMPLE 7

Preparation of diamyl ammonium diamyl dithiocarbamate

Diamyl amine (75.13 grams, 0.478 moles) was charged into a 3-neck, round-bottom flask fitted with agitator, condenser, and thermometer. The reactor was placed in cold-water bath, and the $CS_2$ (46.30 grams, 0.608 moles) was added drop-wise through addition funnel while maintaining the reaction temperature under 40° C. The reaction was then placed aspirator vacuum to remove excess $CS_2$.

EXAMPLE 8 (INVENTIVE)

Preparation of Antimony diamyl dithiocarbamate and zinc diamyl dithiocarbamate Blend (RJT543-218) The product was prepared using a reagent molar ratio of 0.31:1.00 ($ZnO:Sb_2O_3$) giving a Zinc to Antimony ratio of 0.16:1.00. Specifically, diamyl amine (149.8 grams, 0.952 moles), $Sb_2O_3$ (41.9 grams, 0.144 moles), ZnO (3.6 grams, 0.044 moles) and $CS_2$ (79.5 grams, 1.044 moles) were used as reagents and were diluted with 212.1 grams of diluent oil. The product was filtered to remove traces of un-reacted $Sb_2O_3$ and ZnO. The final product was a bright and clear yellow liquid containing 50 mass percent antimony diamyl dithiocarbamate, 5.0 mass percent zinc diamyl dithiocarbamate, and 45 mass percent diluent oil. The antimony and zinc contents were 7.45 and 0.615 mass percent respectively.

EXAMPLE 9 (INVENTIVE)

Preparation of Antimony diamyl dithiocarbamate and zinc diamyl dithiocarbamate Blend (FC539-090) The product was prepared using a reagent molar ratio of 0.61:1.00 ($ZnO:Sb_2O_3$) giving a Zinc to Antimony ratio of 0.31:1.00. Specifically, diamyl amine (86.8 grams, 0.552 moles), $Sb_2O_3$ (22.3 grams, 0.077 moles), ZnO (3.8 grams, 0.047 moles), water (0.5 grams), and $CS_2$ (42.0 grams, 0.551 moles) were reacted and diluted with 100 grams of diluent oil. The product was filtered to remove traces of un-reacted $Sb_2O_3$ and ZnO. The final product was a bright and clear yellow liquid containing 50 mass percent antimony diamyl dithiocarbamate, 10 mass percent zinc diamyl dithiocarbamate, and 40 mass percent diluent oil. Antimony and zinc contents were 7.45 and 1.23 mass percent respectively.

EXAMPLE 10 (INVENTIVE)

Preparation of Antimony diamyl dithiocarbamate and zinc diamyl dithiocarbamate Blend (RJT543-220) The product was prepared using reactant molar ratio of 3.09:1.00 ($ZnO:Sb_2O_3$) giving a Zinc to Antimony ratio of 1.54:1.00. Specifically, diamyl amine (152.8 grams, 0.971 moles), $Sb_2O_3$ (23.3 grams, 0.080 moles), ZnO (20.1 grams, 0.247 moles), and $CS_2$ (81.2 grams, 1.067 moles) were reacted and diluted with 65.5 grams of diluent oil. The product was filtered to remove traces of un-reacted $Sb_2O_3$ and ZnO. The final product was a bright and clear yellow liquid containing 40 mass percent antimony diamyl dithiocarbamate, 40 mass percent zinc diamyl dithiocarbamate, and 20 mass percent diluent oil. Antimony and zinc contents were 5.96 and 4.92 mass percent respectively.

The Timken EP test was used to measure extreme pressure properties of two lithium complex greases treated with compositions produced in Examples 1 through 9. The Timken test is a well-known standardized test, and is described in ASTM D 2509. The Timken test measures the loads at which abrasive wear, i.e. scoring, occur between a rotating cup and stationary block; thus, the higher the Timken OK load, the better the EP properties of the grease. An informal ranking of load-carrying ability based Timken OK load performance is provided below, wherein anything in the range 60-80 (excellent or exceptional) is considered to be acceptable to industry standards:

| Timken OK Load, (lb.) | EP Performance Ranking |
|---|---|
| 80 | Exceptional |
| 60-70 | Excellent |
| 50 | Good |
| 40 | Marginal |

Copper strip test method, ASTM D 4048, was used to evaluate copper corrosion characteristics of two lithium complex greases treated with compositions produced in Examples 1 through 9. In this test method, the polished copper strip is totally immersed in a sample of grease and heated in an oven or liquid bath at a specified temperature for a definite period of time. At the end of this period, the strip is removed, washed, and compared with the ASTM Copper Strip Corrosion Standards. A copper strip is assigned a rating of 1a to 4b. A rating of 1a represents a strip with the least amount of corrosion and 4c represents a strip with the maximum amount of corrosion. Copper corrosion tests were conducted at 100° C. for 24 hours.

Test data is summarized in Tables 2 through 7. In Tables 2, and 3, the corrosion inhibiting properties of carboxylic acids are isolated in two lithium complex greases that were produced by different grease manufactures. The data shows that effective treat rates can differ depending on grease manufacturer. When treated with 3 mass percent VANLUBE® 73 (antimony dithiocarbamate 50% in diluent oil), Grease A requires a minimum teat rate of 0.65 mass percent of alkyl succinic acid half ester derivative, i.e. VANLUBE® RI-A (ester derivative 50% in diluent oil), while Grease B only requires 0.17 mass percent VANLUBE RI-A. Data also shows that the effectiveness of corrosion inhibitor is enhanced when it is added to grease as additive blend with antimony dithiocarbamate. This effect is best illustrated by comparing results of Test 10 and Test 12 in Table 3.

In Table 4, the effective total DTC/Sb molar ratio range was studied. In this study, varying amounts of ammonium dithiocarbamate (Example 7) were added to grease containing 0.22 mass percent antimony brought in from pure antimony dithiocarbamate (Example 1). The data shows that addition of only 0.01 mass percent ammonium dithiocarbamate or an increase in the total DTC/Sb molar ratio from 3.04 to 3.07 improved Timken OK load from 40 pound fail to 40 pound pass. Further improvement in Timken performance is observed when total DTC/Sb molar ratio was increased to 3.33. As shown in Table 5 and Table 6, the effectiveness of ammonium dithiocarbamate is enhanced if ammonium dithiocarbamate is produced in situ in the antimony dithiocarbamate manufacturing process. In the study presented in Table 5, Timken OK load is improved from 60 pounds to 80 pounds by increasing total DTC/Sb molar ratio 3.04 to 3.07 while keeping Sb content constant at 0.30 mass percent. The data show that only greases (Grease A) prepared with additive compositions containing ammonium dithiocarbamate (Examples 4 and 5) were capable of carrying 80 pound loads, and only the grease formulated with VANLUBE RI-A (Example 5) was not corrosive to copper. In study presented in Table 6, Timken load is improved from 40 pound failure to 60 pound pass by increasing total DTC/Sb molar ratio 3.05 to 3.14 while keeping Sb content constant at 0.22 mass percent. Thus, the grease compositions containing ammonium dithiocarbamate (Examples 4 and 6) maintained excellent load-carrying capability at the lower Sb content of 0.22 mass percent. In regards to copper corrosion, all grease compositions were corrosive except for grease composition formulated with Example 6, which contained VANLUBE RI-A.

As indicated Test 31-33 in Table 6, ammonium dithiocarbamates alone can not provide the EP performance seen with antimony dithiocarbamate and ammonium dithiocarbamate compositions. Thus, the EP boost provided by relatively low concentrations of ammonium dithiocarbamates in greases treated with antimony dithiocarbamate is unexpected. In addition, ammonium dithiocarbamates are corrosive and their use at elevated levels will make corrosion inhibition difficult.

Besides ammonium dithiocarbamates, data in Table 7 shows that zinc dithiocarbamates will also significantly improve the load-carrying capabilities of greases containing antimony dithiocarbamates. This observation is also unexpected since zinc dithiocarbamates are not EP agents as confirmed by Test 40 in Table 7.

TABLE 1

| Sample | Components | Sb Content | Total DTC Content | Total DTC/Sb Molar Ratio |
|---|---|---|---|---|
| Example 1 | 50% C5/C8 Antimony DTC<br>50% Diluent Oil* | 7.41% | 42.59% | 2.99 |
| Example 2 | 50% C5 Antimony DTC<br>50% Diluent Oil | 7.45% | 42.55% | 2.99 |
| Example 3 | 80% C5 Antimony DTC<br>20% Diluent Oil | 11.92% | 68.08% | 3.00 |
| Example 4 | 50% C5 Antimony DTC<br>2.5% C5 Ammonium DTC<br>47.5% Diluent Oil | 7.45% | 44.04% | 3.10 |
| Example 5 | 35% C5 Antimony DTC<br>1.7% Ammonium DTC<br>30% VANLUBE RI-A<br>33.3% Diluent Oil | 5.2% | 30.81% | 3.10 |
| Example 6 | 48.8% C5 Antimony DTC<br>2.4% Ammonium DTC<br>2.5% VANLUBE ® RI-A<br>46.3% Diluent Oil | 7.26% | 42.97% | 3.10 |
| Example 7 | 100% Ammonium DTC | 0.0% | 59.49% | — |
| Example 8 | 50% C5 Antimony DTC<br>5% Zinc DTC<br>45% Diluent Oil | 7.45% | 46.94% | 3.31 |
| Example 9 | 50% C5 Antimony DTC<br>10% C5 Zinc DTC<br>40% Diluent Oil | 7.45% | 51.32% | 3.62 |
| Example 10 | 40% C5 Antimony DTC<br>40% C5 Zinc DTC<br>20% Diluent Oil | 5.96% | 69.12% | 6.09 |

*100 neutral severely hyrdo-treated napthenic oil

TABLE 2

Copper Corrosion Data in Lithium Complex Grease A

| | 1 | 2 | 3[3] | 4[3] | 5 | 6 | 7 |
|---|---|---|---|---|---|---|---|
| Base Grease | 100 | 97 | 96 | 96 | 96.7 | 96 | 95.7 |
| VANLUBE 73[1] | | 3 | 3 | 3 | | | |
| Oleic Acid | | | 1 | | | | |
| VANLUBE RI-A[2] | | | | 1 | | | |
| VANLUBE 73/ VANLUBE RI-A[1]: 90/ 10 blend | | | | | 3.3 | | |
| VANLUBE 73/ VANLUBE RI-A: 75/ 25 blend | | | | | | 4 | |
| VANLUBE 73/ VANLUBE RI-A: 70/ 30 blend | | | | | | | 4.3 |
| SbDTC Content (mass %) | 0 | 1.5 | 1.5 | 1.5 | 1.5 | 1.5 | 1.5 |
| Corrosion Inhibitor Content (mass %) | 0 | 0 | 1 | 0.5 | 0.17 | 0.5 | 0.65 |
| Copper Corrosion | 1b | 4b | 1b | 4b | 4b | 4b | 1b |

[1]VANLUBE ® 73 is commercial product available from R.T. Vanderbilt Company, Inc., composed of proprietary mixture of antimony tris (dialkyldithiocarbamate) in 50 mass percent diluent oil.
[2]VANLUBE ® RI-A contains 50 percent diluent oil.
[3]Oleic acid or VANLUBE RI-A was added to grease first.

TABLE 3

Copper Corrosion Data in Lithium Complex Grease B

| | 8 | 9 | 10[3] | 11 | 12 | 13 | 14[4] |
|---|---|---|---|---|---|---|---|
| Base Grease | 100 | 97 | 96.5 | 95.7 | 96.7 | 97 | 96.9 |
| VANLUBE 73[1] | | 3 | 3 | | | | |
| VANLUBE RI-A[2] | | | 0.5 | | | | 0.1 |

TABLE 3-continued

Copper Corrosion Data in Lithium Complex Grease B

| | 8 | 9 | 10[3] | 11 | 12 | 13 | 14[4] |
|---|---|---|---|---|---|---|---|
| VANLUBE 73/ VANLUBE RI-A[1]: 70/ 30 blend | | | | 4.3 | | | |
| VANLUBE 73/ VANLUBE RI-A[1]: 90/ 10 blend | | | | | 3.3 | | |
| Example 2 | | | | | | 3 | 3 |
| SbDTC Content (mass %) | 0 | 1.5 | 1.5 | 1.5 | 1.5 | 1.5 | 1.5 |
| Corrosion Inhibitor Content (mass %) | 0 | 0 | 0.25 | 0.50 | 0.17 | 0 | 0.05 |
| Copper Corrosion | 1b | 4b | 4b | 1b | 1b | 4a | 1b |

[1]VANLUBE 73 is commercial product composed of proprietary mixture of antimony tris (dialkyldithiocarbamate) in 50 mass percent diluent oil.
[2]VANLUBE RI-A contains 50 percent diluent oil.
[3]VANLUBE RI-A was added to grease first.
[4]VANLUBE RI-A was added to grease after Example 2.

TABLE 4

EP Data in Lithium Complex Grease B
SbDTC and AmDTC[1] Added Separately

| | 15 | 16 | 17 | 18 | 19 | 20 |
|---|---|---|---|---|---|---|
| Base Grease | 97 | 96.99 | 96.95 | 96.9 | 96.8 | 96.7 |
| Example 1 | 3 | 3 | 3 | 3 | 3 | 3 |
| AmDTC[1](Example 7) | | 0.01 | 0.05 | 0.1 | 0.2 | 0.3 |
| Sb Content (mass %) | 0.22 | 0.22 | 0.22 | 0.22 | 0.22 | 0.22 |
| Total DTC (mass %) | 1.28 | 1.29 | 1.31 | 1.34 | 1.40 | 1.46 |
| DTC/Sb Molar Ratio | 2.99 | 3.07 | 3.12 | 3.19 | 3.33 | 3.48 |
| Timken OK Load, (lb.) | 40 (Fail) | 40 | 40 | 40 | 50 | 60 |

[1]Ammonium dithiocarbamate

TABLE 5

EP and Copper Corrosion Data in Lithium Complex Grease A

| | 21 | 22 | 23 | 24 |
|---|---|---|---|---|
| Base Grease | 96 | 97.5 | 96 | 94.3 |
| Example 2 | 4 | | | |
| Example 3 | | 2.5 | | |
| Example 4 | | | 4 | |
| Example 5 | | | | 5.7 |
| Sb Content (mass %) | 0.30 | 0.30 | 0.30 | 0.30 |
| AmDTC[1] (mass %) | 0 | 0 | 0.1 | 0.1 |
| Total DTC (mass %) | 1.70 | 1.70 | 1.76 | 1.76 |
| DTC/Sb Molar Ratio | 2.99 | 3.00 | 3.11 | 3.10 |
| VANLUBE RI-A[2] (mass %) | 0 | 0 | 0 | 1.7 |
| Timken OK Load, (lb.) | 60 | 70 | 80 | 80 |
| Copper Corrosion | 4b | 4b | 4a | 1b |

[1]Ammonium dithiocarbamate
[2]VANLUBE RI-A is 50 mass percent active. Thus, total corrosion inhibitor in Example 5 is 0.85 mass percent.

TABLE 6

EP and Copper Corrosion Data in Lithium Complex Grease B

| | 25 | 26 | 27 | 28 | 29 | 30 | 31 | 32 | 33 |
|---|---|---|---|---|---|---|---|---|---|
| Base Grease | 96 | 97 | 97.5 | 98.1 | 97 | 96.9 | 99 | | |
| Example 2 | 4 | 3 | | | | | | | |
| Example 3 | | | 2.5 | 1.9 | | | | | |
| Example 4 | | | | | 3 | | | | |
| Example 6 | | | | | | 3.1 | | | |
| AmDTC[1] (Example 7) | | | | | | | 1 | 2.2 | 2.2 |
| VANLUBE RI-A | | | | | | | | | 0.1 |
| Sb Content (mass %) | 0.30 | 0.22 | 0.30 | 0.22 | 0.22 | 0.22 | 0 | 0 | 0 |
| AmDTC[1] (mass %) | 0 | 0 | 0 | 0 | 0.08 | 0.08 | 1 | 2.2 | 2.2 |
| Total DTC Content (mass %) | 1.70 | 1.28 | 1.70 | 1.28 | 1.32 | 1.32 | 0.59 | 1.31 | 1.31 |
| DTC/Sb Molar Ratio | 2.99 | 2.99 | 3.00 | 3.00 | 3.11 | 3.10 | — | — | — |
| VANLUBE RI-A[2] (mass %) | 0 | 0 | 0 | 0 | 0 | 0.1 | 0 | 0 | 0.1 |
| Timken OK Load, (lb.) | 80 | 40 | 80 | 40 (Fail) | 60 | 60 | 40 (Fail) | 50 | — |
| Copper Corrosion | 4a | 4a | 4a | 1b | 4b | 1a | 4a | 4b | 4b |

[1]Ammonium dithiocarbamate

[2]VANLUBE RI-A is 50 mass percent active. Thus, total corrosion inhibitor in Example 4 is 0.05 mass percent.

TABLE 7

EP and Copper Corrosion Data in Lithium Complex Grease B

| | 34 | 35 | 36 | 37 | 38 | 39 | 40 |
|---|---|---|---|---|---|---|---|
| Base Grease | 98.1 | 97 | 97 | 96.25 | | | 96 |
| Example 3 | 1.9 | | | | | | |
| Example 8 | | 3 | | | | | |
| Example 9 | | | 3 | | | | |
| Example 10 | | | | 3.75 | 3.00 | 2.1 | |
| VANLUBE ® AZ[3] | | | | | | | 4 |
| Sb Content (mass %) | 0.22 | 0.22 | 0.22 | 0.22 | 0.18 | 0.126 | 0 |
| Zn Content (mass %) | 0 | 0.02 | 0.04 | 0.18 | 0.14 | 0.098 | 0.24 |
| Total DTC Content (mass %) | 1.28 | 1.41 | 1.54 | 2.60 | 2.08 | 1.46 | 1.76 |
| DTC/Sb Molar Ratio | 3.00 | 3.31 | 3.62 | 6.09 | 6.09 | 6.09 | — |
| Timken OK Load, (lb.) | 40 (Fail) | 70 | 80 | 80 | 80 | 60 | 40 (Fail) |
| Copper Corrosion | 1b | 1b | 1b | 1b/4a[4] | 1b/4a[4] | 1b | 1a |

[3]VANLUBE ® AZ is commercial zinc diamyl dithiocarbamate produced by R. T. Vanderbilt Company Inc.

[4]Rating is a 1b with very fine 4a lines.

What is claimed is:

1. A lubricating composition comprising:

a lubricating grease and about 0.1-10% of an additive composition comprising:

(a) antimony diamyl dithiocarbamate, and (b) diamyl ammonium diamyl dithiocarbamate, wherein the antimony content of the composition is about 0.20 to 0.30 mass %, and the molar ratio (total DTC:Sb) of total dithiocarbamate molecules in (a) and (b) to antimony is about 3.06 to 3.50:1 .

2. The composition of claim 1, wherein the ratio total DTC:Sb is about 3.07 to 3.11:1.

3. The composition of claim 1, wherein the composition further comprises (c) a compound containing a carboxylic-acid functional group.

4. The composition of claim 3, wherein (c) is present at about 0.01 to 1% of the total lubricating composition.

5. The composition of claim 3, wherein (c) is alkyl succinic acid half ester derivative.

6. A method of increasing the extreme pressure performance of antimony dithiocarbamates in a lubricating grease, comprising the steps of forming an additive composition comprising (a) antimony dithiocarbamate and (b) zinc dithiocarbamate by reacting together in a single step a secondary amine and carbon disulfide with $Sb_2O_3$ and ZnO, and adding to the grease about 0.1-10% of the additive composition to form a lubricating grease composition, such that the antimony content of the lubricating grease composition is about 0.12 to 0.22 mass %, and the molar ratio (total DTC:Sb) of total dithiocarbamate molecules in (a) and (b) to antimony is about 3.1 to 6.1:1.

* * * * *